US006585032B2

(12) United States Patent
Schwerdtfeger et al.

(10) Patent No.: US 6,585,032 B2
(45) Date of Patent: Jul. 1, 2003

(54) STRIP CASTING PLANT

(75) Inventors: Klaus Schwerdtfeger, Goslar (DE); Karl-Heinz Spitzer, Clausthal-Zellerfeld (DE); Paul Freier, Clausthal-Zellerfeld (DE); Thomas Von Hinrichs, Buntenbach (DE); Wolfgang Reichelt, Moera (DE); Ulrich Urlau, Moers (DE); Ewald Feuerstacke, Dorsten (DE); Joachim Kroos, Meine (DE); Michael Brühl, Wolfenbüttel (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 10/008,717

(22) Filed: Nov. 5, 2001

(65) Prior Publication Data

US 2002/0079084 A1 Jun. 27, 2002

Related U.S. Application Data

(63) Continuation-in-part of application No. 09/202,036, filed on Aug. 2, 1999, now abandoned.

(30) Foreign Application Priority Data

Jun. 7, 1996 (DE) ..... 196 22 925
Sep. 10, 1996 (DE) ..... 196 36 698

(51) Int. Cl.[7] ..... B22D 11/06; B22D 11/04

(52) U.S. Cl. ..... 164/463; 164/423; 164/478; 164/416; 164/427; 164/479

(58) Field of Search ..... 164/478, 416, 164/427, 479, 463, 423

(56) References Cited

FOREIGN PATENT DOCUMENTS

| | | | | |
|---|---|---|---|---|
| JP | 58-29533 | * | 2/1983 | ..... 164/478 |
| JP | 61-042454 | * | 2/1986 | |
| JP | 62-230458 | * | 10/1987 | |

* cited by examiner

*Primary Examiner*—Tom Dunn
*Assistant Examiner*—T. H. Lin
(74) *Attorney, Agent, or Firm*—Cohen, Pontani, Lieberman & Pavane

(57) ABSTRACT

A strip casting plant with side limits arranged closely adjacent to a carrying belt. The side limits, and preferably the supply device for molten metal, are capable of vibrating and are connected to a device for producing vibrations. The adhesion of solidified material can thus be prevented.

3 Claims, 1 Drawing Sheet

STRIP CASTING PLANT

This is a continuation-in-part of application Ser. No. 09/202,036, filed Aug. 2, 1999 and now abandoned.

BACKGROUND OF THE INVENTION

1. Field of the Invention

The invention relates to a strip casting plant, especially for the strip casting of steel.

2. Discussion of the Prior Art

When strip casting steel, it is largely possible to optimally select the casting thickness of the strip (e.g., approximately 10 mm) in keeping with the required thickness of the finish-rolled hot strip (1 to 3 mm) and for the purpose of attaining adequate material properties in light of the required heat deformation.

DE 31 42 099 discloses a device for the continuous casting of metal that has a supply device for molten metal, a carrying belt for molten and solidified metal, and side limits closely adjacent to the carrying belt. The side limits are attached to the carrying belt in the manner of a link chain.

Such a design is quite expensive technically. Moreover, it is basically suitable only for relatively small strip widths. The stress in the carrier due to the thermal load is substantially higher with larger strip widths than with narrow strips. Thus, the aforementioned side limit, which revolves in a chain-like fashion and acts as a reinforcement, cannot be used with large strip widths.

When side limits are used that remain stationary relative to the carrier or conveyance device of the cast strip, solidified steel occasionally sticks to a side limit during the casting process. This leads to massive defects in the strip and to operational disruptions or even interruptions in casting. Similar problems can occur in the supply device, since solidified steel occasionally sticks there as well, leading to similar difficulties.

BRIEF DESCRIPTION OF THE DRAWINGS

The single FIGURE schematically illustrates the inventive device.

SUMMARY AND DESCRIPTION OF THE INVENTION

Figure 1:
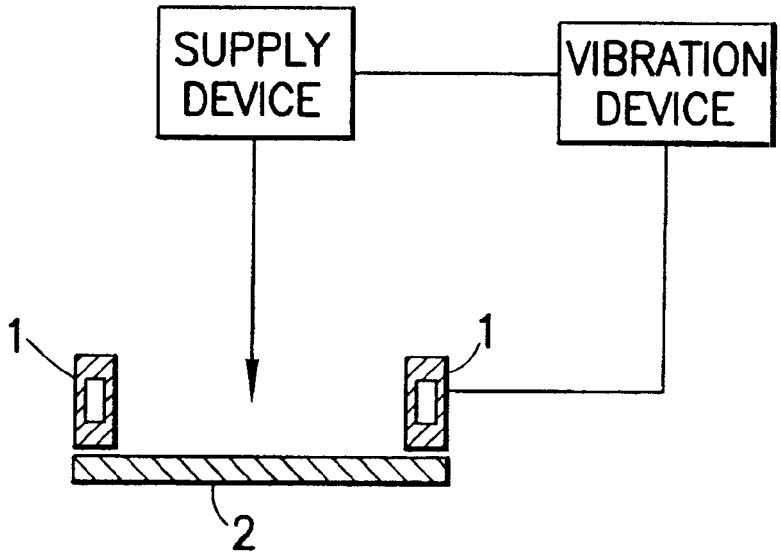

The object of the present invention is to provide a strip casting plant that reliably prevents the adhesion of solidified steel to the supply device or side limits.

This object is attained by embodying the supply device and/or side limits 1 so that they can vibrate on the plane of the carrying belt 2 and are connected to a device that produces vibrations. This measure prevents the adhesion of solidified material.

In a preferred embodiment, the vibrations of the supply device and/or side limits occur substantially perpendicular to the conveyance device of the strip. Thus, the vibrations occur on the plane of the carrying belt or the cast steel strip, but at a right angle to the conveyance device. Advantageously, this design is less expensive than one that vibrates in the conveyance direction, wherein the side limits would have to run exactly over the entire length. In addition, this embodiment advantageously allows the vibrations to be optimally adjusted in the region of the metallurgical length (from the pouring area to complete strip solidification). This is done, for example, by dividing the side limits in this region into individual sections with optimal frequencies and amplitudes.

In a further preferred embodiment, the side limits can be set at an angle relative to each other. This is true for side limits located across from each other as well as for sections located on one particular side. That is, the side limits located across from each other may be adjusted simultaneously for adjusting the thickness of the cast strip across the width of the cast strip or a section of the side limit on one particular side of the cast strip may be individually adjusted for adjusting the thickness at one side of the cast strip. As a result, the evenness of the strip thickness can be improved over the entire width of the cast strip.

In a preferred example, the side limits comprise water-cooled hollow profiles.

Preferably, the devices to produce the vibrations are eccentric drives. However, electric magnets or hydraulic cylinders can also be used. The vibrations can be sinusoidal, sawtoothed or trapezoidal in form, for example. The stroke frequency is, for example, 50 Hz at a stroke of 0.5 mm. The cooling water is supplied via flexible hoses. Over the cast strip, there is preferably a cover, in which a layer of temperature-stable sealing material, especially ceramic fiber felt, is arranged for the purpose of sealing between the side limits and the cover. A corresponding seal is also provided between the supply device and the carrying belt, whereby an aluminum sheet is preferably inserted between the carrying belt and the seal, so that when vibrations occur, relative movement takes place only between the felt layer and the aluminum sheet. The supply device and the side limits are preferably held by helical screws.

In a further preferred embodiment, the side limits can simultaneously vibrate both perpendicular and parallel to the strip movement (casting direction), so that all told a thrust force that also acts in the casting direction is exerted on the strip edge. Specifically, the vibration has components in all three spatial directions.

Furthermore, the vibrations can occur perpendicular to the strip surface.

In a another embodiment, the vibrations are generated by impacts in the longitudinal or transverse direction of the side limits. Shock-like longitudinal waves, with which adhesion can be effectively prevented, can be applied in this way.

What is claimed is:

1. A strip casting plant, comprising:

a supply device for supplying molten metal;

a carrying belt for carrying a strip of molten and solidified metal, the supply device being arranged to supply molten metal to the carrying belt;

side limits closely adjacent to the carrying belt, the side limits being adjustable at an angle to each other for improving an evenness of a thickness of the strip on the carrying belt over a width of the strip; and means for vibrating at least one of the supply device and the side limits in a plane of the carrying belt, the vibrating means being operative to vibrate at least one of the supply device and the side limits substantially perpendicular to an upper surface of the strip so as to cause relative movement between the supply device and the side limits in a first spatial direction, and to vibrate the side limits simultaneously both perpendicular (second spatial direction) and parallel (third spatial direction) to a casting direction so that the vibration has components in three spatial directions.

2. A strip casting plant as defined in claim 1, wherein the side limits have at least one hollow profile section that can be water cooled.

3. A method for preventing adhesion of solidified steel to a molten steel supply device and side limits adjacent a carrying belt for molten and solidified metal, in a strip casting plant, the method comprising vibrating at least one of the supply device and the side limits in a plane of the carrying belt substantially perpendicular to a conveyance direction of a strip produced by the casting plant, and adjusting the side limits at an angle to each other for improving an evenness of a thickness of the strip on the carrying belt over a width of the strip.

* * * * *